United States Patent [19]

Wilcox

[11] 4,396,037

[45] Aug. 2, 1983

[54] ELECTRO-HYDRAULIC CONTROL VALVE

[75] Inventor: Kenneth Wilcox, Melbourne, England

[73] Assignee: Expert Industrial Controls Limited, England

[21] Appl. No.: 263,165

[22] Filed: May 13, 1981

[30] Foreign Application Priority Data

May 17, 1980 [GB] United Kingdom ..... 8016389

[51] Int. Cl.[3] ..... F15B 13/044

[52] U.S. Cl. ..... 137/625.65; 251/130; 251/137

[58] Field of Search ..... 137/625.65; 251/130, 251/137, 141

[56] References Cited

U.S. PATENT DOCUMENTS

| | | | |
|---|---|---|---|
| 2,145,977 | 2/1939 | Foster | 251/137 X |
| 2,967,545 | 1/1961 | Schmidt | 137/625.65 |
| 3,092,145 | 6/1963 | Brinkel | 137/625.65 |
| 3,995,652 | 12/1976 | Belart et al. | 137/625.65 X |
| 4,253,493 | 3/1981 | English | 137/625.65 X |
| 4,310,143 | 1/1982 | Determan | 137/625.65 X |

FOREIGN PATENT DOCUMENTS

| | | | |
|---|---|---|---|
| 2209206 | 8/1973 | Fed. Rep. of Germany | 251/137 |
| 1018602 | 1/1966 | United Kingdom | 251/137 |

*Primary Examiner*—Gerald A. Michalsky

[57] ABSTRACT

An electro-hydraulic control valve comprises a central body in which is formed a bore located within which is a valve member. At least the end portions of the valve member are formed from magnetizable material. The body carries solenoid devices disposed at the opposite ends of the bore so that when the one or the other device is energized the valve member is pulled towards the respective end of the bore.

6 Claims, 6 Drawing Figures

ELECTRO-HYDRAULIC CONTROL VALVE

This invention relates to electro-hydraulic control valves, the object of the invention being to provide such valves in a simple and convenient form.

According to the invention an electro-hydraulic control valve comprises a central body part defining an axial bore, a valve member at least the end portions of which are formed from magnetisable material, slidable in said bore, the axial position of said valve member in the bore determining the degree of registration of groove means formed in the wall of the bore and recess means in the valve member, and a pair of solenoid devices mounted at the opposite ends of said bore, each of said devices including a winding which can be energised to exert a magnetic force on the respective end portion of the valve member to pull the valve member towards the respective end of the bore.

An example of a valve in accordance with the invention will now be described with reference to the accompanying drawings in which.

Figure 1:
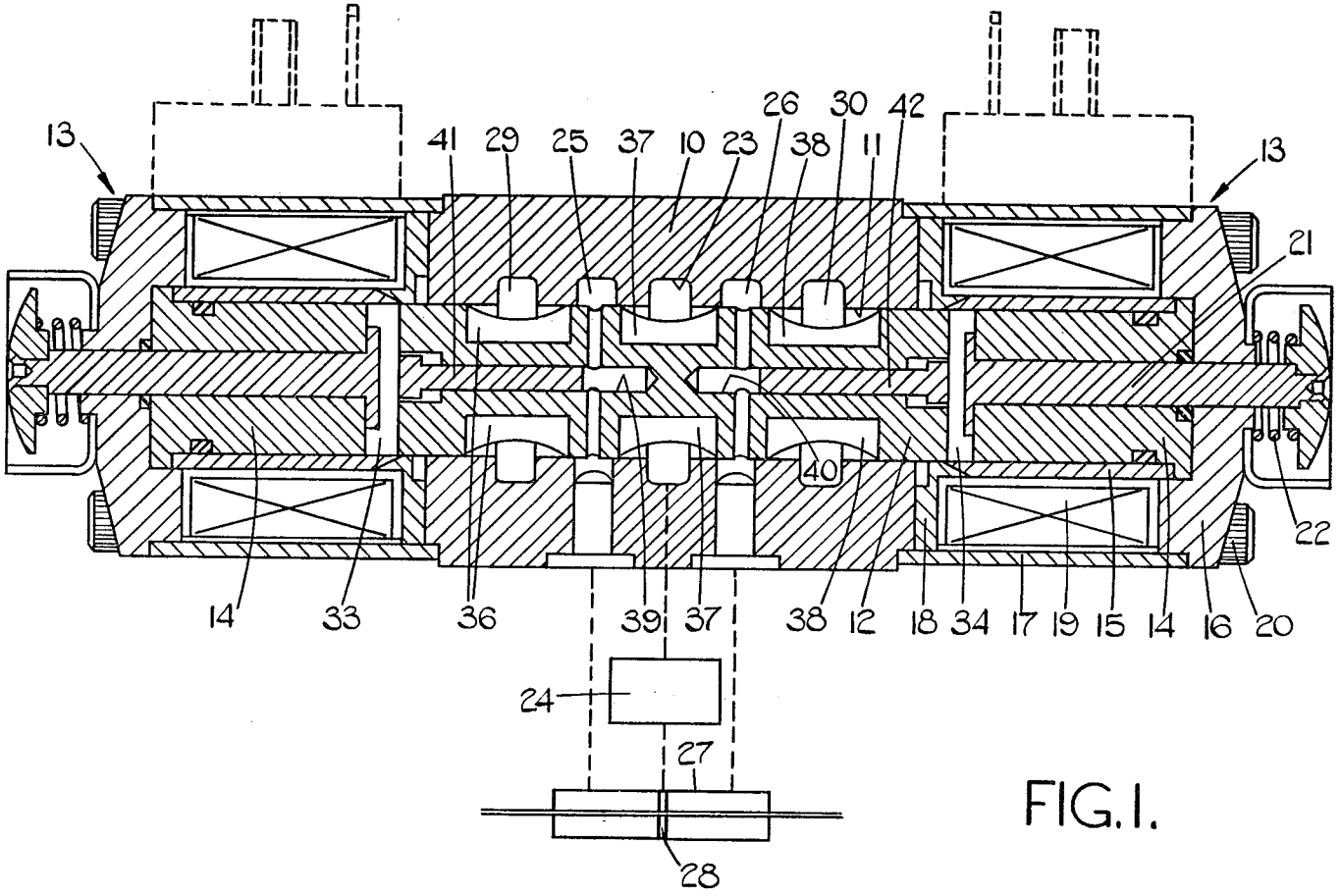
FIG. 1 is a sectional side elevation of a proportional control valve.

The valve comprises a central body part 10 formed from magnetisable material and having an axial bore 11 extending therethrough. Slidable axially within the bore is a valve member 12 which is formed from magnetisable material. The valve member in the mid-position as shown, extends from the ends of the bore 11.

Mounted at the opposite ends respectively of the body part 10 are solenoid devices 13 respectively. Each device comprises a core member 14 formed from magnetisable material which is housed within a tubular member 15 also formed from magnetisable material. The core member and tubular member extend into a recess formed in an end closure 16 which carries an annular yoke 17. Each device also includes an annular flanged member 18 formed from non-magnetisable material. The flange of the member in use engages in fluid tight relationship, the end face of the body part 10. The member 15 together with the member 18 and the yoke 17 define an annular recess in which is wound an electrical winding 19. The yoke 17 extends beyond the member 18 and is located in a suitable recess defined about the periphery of the central body part. The solenoid devices are secured to the body part by means of suitable clamping bolts 20.

In the particular example, the core member 14 is provided with a through bore in which is located a push member 21 which is biassed in an outwards direction, by means of a spring 22. The outer end of the push member is adapted to be depressed manually to effect movement of the valve member 12 as will be described. Conveniently the bore which accommodates the push member 21 is provided with a circumferential groove which retains an annular sealing ring to minimise the risk of leakage of fluid along the working clearance defined between the push member and the wall of the bore.

When one of the windings 19 is supplied with electric current the core member 14 and the body part 10 assume opposite magnetic polarity and a force acts upon the valve member 12 to pull the latter in a direction towards the solenoid device, the winding of which is energised.

Figure 3:
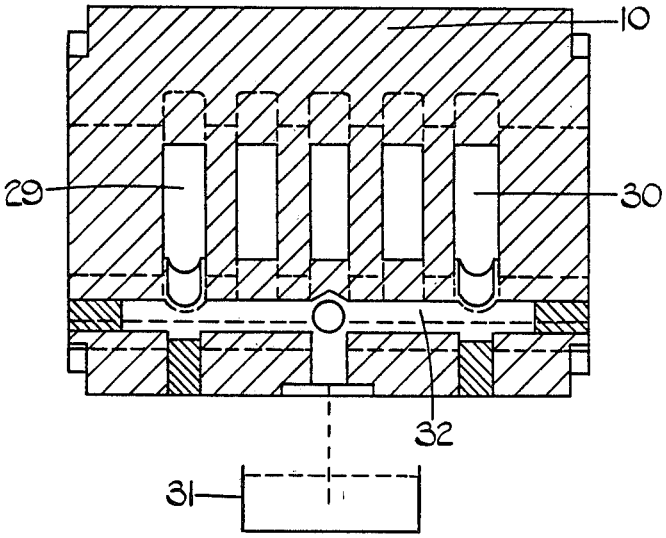
FIG. 3 is a view similar to FIG. 2 on the line B—B of FIG. 4.
Figure 4:
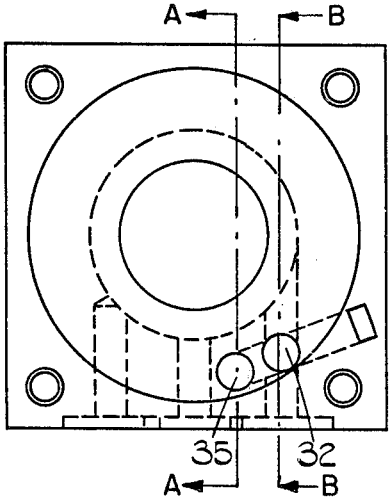
FIG. 4 is an end view of the valve body part.
Figure 5:
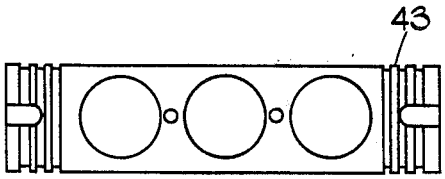
FIG. 5 is an exterior view of the valve member and FIG. 6 is a part sectional view of a modified valve member.

The bore 11 is provided with 5 circumferential grooves the central one referenced 23, is in use connected to a source of fluid under pressure illustrated as a pump 24. The adjacent grooves 25, 26 are connected to the opposite ends respectively of a cylinder 27 which contains a double acting piston 28. The two outermost grooves 29, 30 are connected to a drain which is illustrated as a tank 31 from which the pump draws liquid, the connection being as shown in FIG. 3, by way of a passage 32 extending axially within the body part and having a central connection to the tank.

Figure 2:
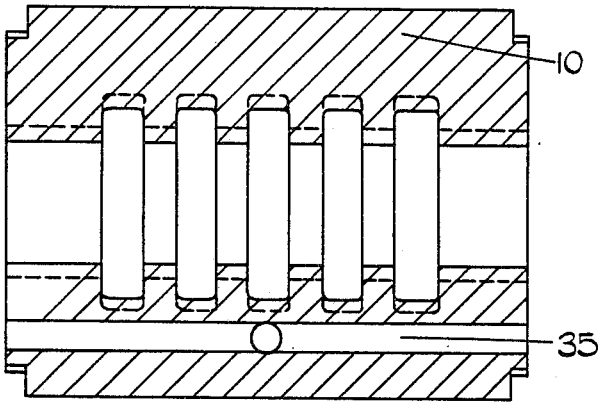
FIG. 2 is a section through the valve body part on the line A—A of FIG. 4.

The spaces 33, 34 defined by the solenoid assemblies also communicate with the drain or tank, this communication being achieved by way of a passage 35 formed in the body part 10 as shown in FIG. 2, the central portion of the passages 32 and 35 communicating by means of a cross drilling. The valve member is provided with three sets of recesses 36, 37, 38. In the central position of the valve member 12, the grooves 25, 26 are just covered by the plain portions of the valve member but any displacement of the valve member, say for example towards the left, will place the groove 25 in communication with the groove 23 and the groove 26 in communication with the groove 30 with the result that fluid can flow from the right hand end of the cylinder 27 to the tank 31 and to the left hand end of the cylinder from the pump. The piston will therefore move towards the right hand end of the cylinder.

The end faces of the valve member are provided with a pair of inwardly extending blind drillings 39, 40 respectively the inner ends of which communicate with the grooves 25, 26 respectively by way of radially disposed passages. The drillings are occupied by cylindrical members 41, 42 respectively and which can be urged outwardly beyond the ends of the valve member into contact with the ends of the push members 21. Since the inner ends of the drillings communicate with the aforesaid grooves 25, 26 the valve member is subject to a force representative of the fluid pressure in the grooves and if for example the valve member 12 is pulled towards the left by energising the winding of the left hand device 13, so as to cause movement of the piston 28 towards the right, when the latter is restrained from movement so that the pressure in the left hand end of the cylinder 27 increases, a similar increase in pressure will occur in the left hand drilling 39 and this pressure will act upon the valve member 12 to move the valve member towards the right. There is thus applied to the valve member a restoring force which opposes the displacement of the valve member by the magnetic force created by the current flowing in the respective winding. Hence, the pressure differential between the grooves 25, 26 is dependant upon the magnitude of the current flowing in one or the other of the windings. The valve member can of course be displaced by depression of one or the other of the push members and there will of course be developed a reaction force on the push member, this force normally being taken by the respective core member.

Figure 6:
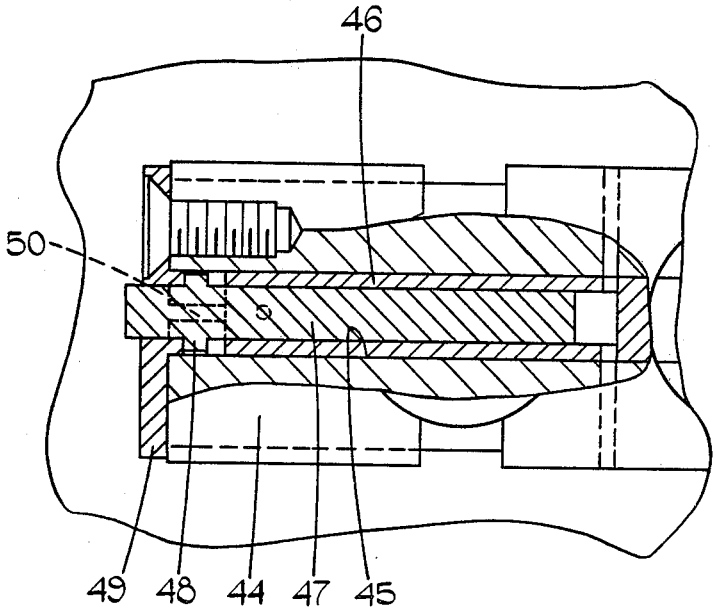

In the event that the supply of electric current to the windings ceases and a fluid pressure exists on one side of the piston 28, the valve member will move under the action of this fluid pressure to relieve the fluid pressure on the one side of the piston and to increase the fluid pressure on the other side of the piston. In order to prevent such movement the construction of the valve member shown in FIG. 6 is adopted in which in the central position of the valve member, the ends of the cylindrical members are just clear of the faces of the push members. Hence the valve member cannot be urged by pressure in the cylinder beyond the central position so that the fluid pressure in the situation set out above will be sustained.

In FIG. 6 the valve member 44 is provided with a central drilling 45 in the opposite ends of which are located inserts 46 respectively. The inserts define blind bores the inner ends of which communicate with the grooves 25, 26 respectively. The blind bores accommodate the aforesaid cylindrical members 47 which have the same diameters as the bores but which also have a flange 48 which can for the purpose of limiting the movement of the cylindrical members, engage the adjacent end of the insert 46 or with a plate 49 secured to the end of the valve member. The cylindrical member extends through an aperture in the plate for engagement as previously described with the push member. A groove 50 is provided in the bore 45 to allow fluid to flow between the opposite ends of the flange 48.

In the construction described the valve member constitutes the armature of the solenoid devices. This provides the important advantage over known devices in that the magnetic forces acting to displace the valve member act at the ends of the valve member to in effect, pull the valve member to the required position. In known devices the armatures are separate from the valve member and for reasons of alignment only abut the valve member, so that a pushing action is obtained. The possibility of the armature sticking within the bore is by virtue of the fact that it is pulled, reduced and friction is also reduced so that more accurate control can be obtained. In addition there is a reduction in the number of working parts.

A further advantage is that all the high pressure parts and passages are contained within the central portion of the body part and this has the important advantage that the various seals are subject to the pressure in the pipeline leading to the tank from the passage 35.

An important feature of the construction is the connection of the passages 32 and 35 to each other and to the tank at their mid points. It would be more convenient to connect the spaces 33, 34 to the adjacent grooves 29, 30 but with this connection it has been discovered that there can be a substantial pressure created in whichever of the grooves is receiving fluid from the cylinder. The passages 32 and 35 are therefore provided and inter-connected in the manner described so that the ends of the valve member will be subject to the same pressure.

In order to reduce friction further circumferential grooves 43 may be provided in the plain end portions of the valve member. The end portions of the valve member must be formed from magnetisable material but the central portion can be formed from a suitable non-magnetic material.

I claim:

1. An electro-hydraulic control valve comprising a central body part, an axial bore in the body part and a valve member slidable therein, at least the end portions of said valve member being formed from magnetisable material, a pair of solenoid devices mounted at the opposite ends of said bore, each of said devices including a winding which can be energised to exert a magnetic force on the respective end portion of the valve member to pull the valve member towards the respective end of the bore, groove means comprising five axially spaced circumferential grooves formed in the wall of the bore, the central one of said grooves being an inlet groove and being connected in use to a fluid pressure source, the outer pair of grooves being drain grooves and being connected in use to a drain, the inner pair of grooves being outlet grooves and being connected in use to the opposite ends of a double acting fluid pressure operable mechanism, the valve member having three axially spaced sets of recesses in its peripheral surface, said grooves and recesses being arranged so that in the intermediate position of the valve member the grooves will be covered by the valve member and as the valve member is moved to one side or the other, the central groove will be placed in communication with one of said outlet grooves, the other outlet groove being placed in communication with the adjacent one of the drain grooves, a pair of blind drillings extending inwardly from the ends of the valve member, cylindrical members slidable in said drillings respectively and passages connecting the inner ends of said drillings with said outlet grooves respectively whereby the valve member is subject to a force which depends upon the fluid pressures in said outlet grooves, the force acting to oppose movement of the valve member by the solenoid devices.

2. A valve according to claim 1 including spaces defined at the opposite ends of the valve member, a first passage in the body part interconnecting said spaces, a second passage in the body part interconnecting said drain grooves, a drain port in the body connected to said second passage midway between its ends, said first passage being connected to said second passage at points midway between the ends of the passages.

3. A valve according to claim 1 including abutments at the opposite ends of the bore for engagement by said cylindrical members respectively.

4. A valve according to claim 3 including means for limiting the extent of outward movement of said cylindrical members whereby when the solenoid devices are de-energised said valve member will remain in said intermediate position.

5. A valve according to claim 4 in which said abutments are defined by manually operable push members respectively and spring means biasing said push members away from said valve member.

6. A valve according to claim 5 in which said push members extend within through bores formed in core members forming part of said solenoid devices respectively.

* * * * *